US006283391B1

(12) United States Patent
Ferraro et al.

(10) Patent No.: US 6,283,391 B1
(45) **Date of Patent: *Sep. 4, 2001**

(54) FUEL INJECTOR

(75) Inventors: Giovanni Ferraro, Ludwigsburg; Hansjoerg Egeler, Fellbach; Andreas Wengert, Oppenweiler, all of (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/380,768

(22) PCT Filed: Feb. 7, 1998

(86) PCT No.: PCT/DE98/03580

§ 371 Date: Sep. 13, 1999

§ 102(e) Date: Sep. 13, 1999

(87) PCT Pub. No.: WO99/43952

PCT Pub. Date: Sep. 2, 1999

(30) Foreign Application Priority Data

Feb. 28, 1998 (DE) ..... 198 08 610

(51) Int. Cl.[7] ..... F02M 61/00

(52) U.S. Cl. ..... 239/533.2; 239/589; 137/561 A; 137/561 R

(58) Field of Search ..... 239/589, 590, 239/533.1, 533.2, 533.3, 533.4, 533.5, 533.6, 533.7, 533.8, 533.9, 533.11, 533.12, 533.13, 533.14, 533.15, 88–95; 137/561 R, 884, 594, 595, 561 A

(56) References Cited

U.S. PATENT DOCUMENTS 1,660,557 * 2/1928 Heimburger ..... 239/589
3,738,576 * 6/1973 O'Neill ..... 239/533.8
5,133,503 * 7/1992 Giordano et al. ..... 239/589

* cited by examiner

*Primary Examiner*—David A. Scherbel
*Assistant Examiner*—Christopher S. Kim
(74) *Attorney, Agent, or Firm*—Ronald E. Greigg; Edwin E. Greigg

(57) ABSTRACT

A component having a bore, in which at least one partial region of the component has an angle of inclination between a center axis and an axis of the bore, in which the bore has a single continuous axis, and the component has at least one partial region in which the center axis is displaced out of the total center axis of the component.

11 Claims, 1 Drawing Sheet

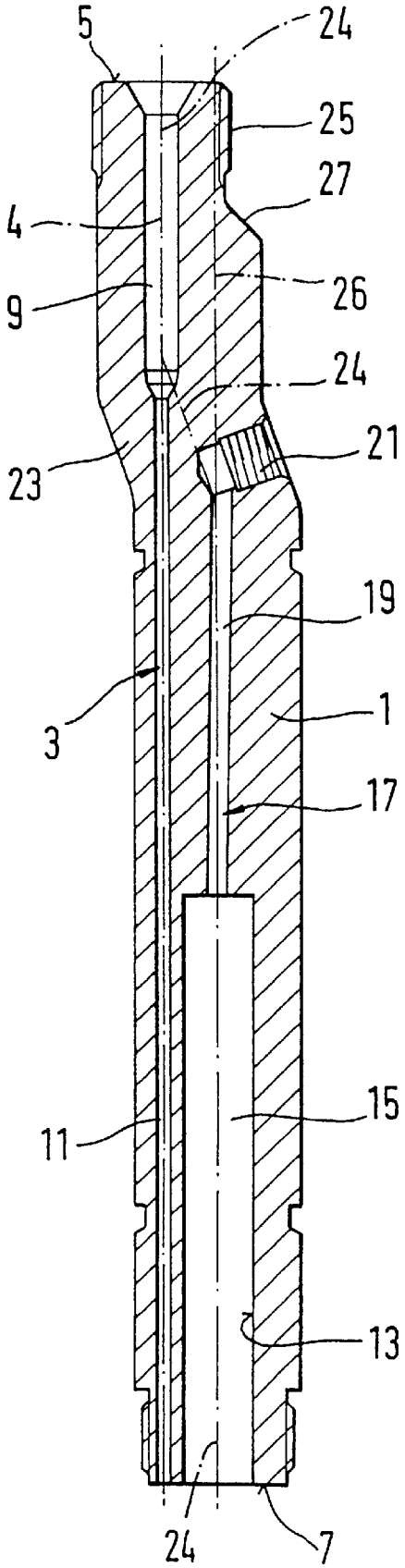
FIG. 1
FIG. 2
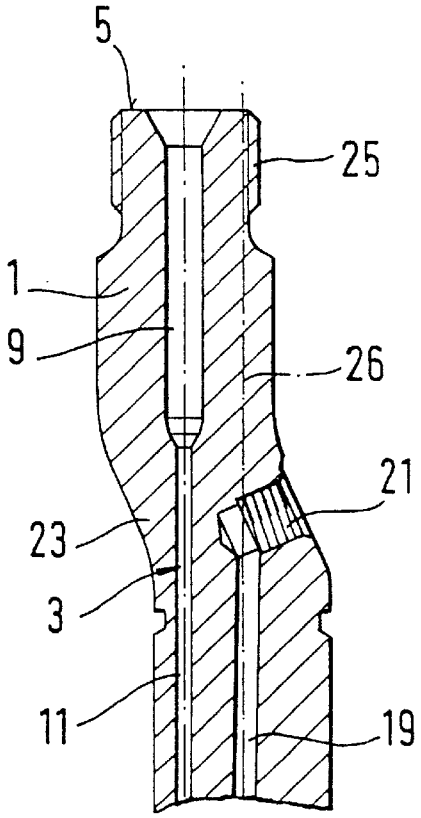

FUEL INJECTOR

PRIOR ART

The invention is based on a component having a bore, in which at least one partial region of the component has an angle of inclination between its center axis and an axis of the bore. In one such component, known from German Published, Nonexamined Patent Application DE-OS 195 47 423 A1, the bore is embodied as an axial through bore, which centrally enters the component at a first axial end face and exits the component eccentrically to the axis of the component at a second end face remote from the first. The through bore, embodied as an angled bore, serves as a high-pressure fuel conduit in a valve holding body of a fuel injection valve for internal combustion engines, by way of which fuel is carried by a conduit at high pressure to the fuel injection valve, protruding into the engine combustion chamber. The inlet opening of the upper, obliquely extending bore portion is disposed centrally in an upper end face, while the exit opening of the second bore portion, extending in a straight line, is disposed eccentrically in a second, lower end face of the valve holding body. This is necessary so that a further blind bore, forming a spring chamber, can be made in the valve holding body in its lower region.

The angled through bore in the known valve holding body has the disadvantage, however, that in the overlapping region between the portion of the bore extending obliquely to the axis of the valve holding body and the portion of the bore extending straight relative to it, a weakening occurs in terms of the high-pressure strength of the valve holding body. The result, especially at very high pressure threshold stresses of over 1800 bar, is breakage, which can lead to the failure of the entire injection system and thus the entire internal combustion engine. Furthermore, turbulence of the fuel flowing through the overlapping region occurs at the corresponding edges of the bore, and this worsens the flow behavior to the fuel injection valve. Even with very complicated grinding methods, for instance by using abrasive grinding agents, it is hardly possible to machine this bore transition optimally, and so the course of the angled bore in the valve holding body does not meet the stringent demands made of modern injection systems.

ADVANTAGES OF THE INVENTION

The component according to the invention, having a bore that at least in part forms an angle of inclination with a partial region of the axis of the component, has the advantage over the prior art that bore overlaps or edges resulting from a kinked course of the bore can be avoided. This is advantageously made possible by providing that the bore, preferably an axial through bore, has only a single, uncurved, continuous axis and thus is embodied as a straight bore throughout. In order nevertheless to achieve a relative axial offset of the bore from the axis of the component, the component has a partial region that is displaced out of the total center axis of the component. For example by means of an offset-bent embodiment of the component, a course of the through bore as a straight bore becomes possible, and this bore can also be embodied as a stepped bore. Compared with a kinked bore course, this straight bore has the advantage that better flow behavior inside the bore can be attained. In addition, the overall pressure threshold strength of the component can be increased, since the originally critical region of the transition between the oblique and the straight bore is omitted. A further advantage of the embodiment of the component according to the invention is that the through bore in the component is very much simpler to produce. The through bore advantageously centrally enters the component at a first axial end face thereof and exits the component eccentrically to its axis at a second end face opposite the first. Alternatively, both the entrance and exit and the centricity and eccentricity of the through bore at the end faces can be transposed. An eccentric course of the bore in one of the end faces advantageously makes it possible to provide a further bore at this end face, such as an additional reception chamber for a restoring member (such as a valve spring or hydraulic piston) of an injection valve. This further bore may be placed either centrally or eccentrically in the end face of the component.

The embodiment according to the invention of the component will be described taking as an example a valve holding body for a fuel injection valve for internal combustion engines, but it is alternatively possible in all components in which a kinked bore is necessary because of a central bore entrance and an eccentric bore exit.

The size of the offset bend of the preferably cylindrical component depends on the axial offset of the bore to be made and on the position of a possible adjoining thread on the component. This adjoining thread may be provided either centrally or eccentrically to the offset bend.

Further advantages and advantageous features of the subject of the invention can be learned from the description, drawing, and claims.

BRIEF DESCRIPTION OF THE DRAWING

Two exemplary embodiments of the component of the invention having a bore are shown in the drawing and will be described in further detail in the description.

FIG. 1 shows a first exemplary embodiment, in which the component is embodied as a valve holding body of a fuel injection valve for internal combustion engines, and in which the adjoining thread is disposed eccentrically on the valve holding body, and FIG. 2 shows a second exemplary embodiment, with a component embodied as a valve holding body in which the adjoining thread is disposed centrally on the valve holding body.

DESCRIPTION OF THE EXEMPLARY EMBODIMENTS

The exemplary embodiments, shown in FIGS. 1 and 2, of a component having a bore are embodied as a valve holding body of a fuel injection valve for internal combustion engines, not shown in detail here.

FIG. 1 shows a first exemplary embodiment of a valve holding body 1, which has an axial through bore, forming the bore, that acts as a high-pressure conduit for supplying the fuel, which is at high pressure, to the injection valve, not shown in detail here.

The through bore 3, embodied as a straight bore with a single, continuous axis 4, enters centrally into the substantially cylindrical valve holding body 1 at a first upper end face 5 thereof and exits from the body again eccentrically to the axis of the valve holding body 1 at a second, lower end face 7. In the exemplary embodiment, the through bore 3 is embodied as a stepped bore and has a portion of larger diameter 9 in its upper region that enters the valve holding body centrally and a portion 11 of smaller diameter in the middle and lower region of the valve holding body 1. The axial length of the larger-diameter portion 9 of the bore is equivalent to the length of a fuel filter, not shown, that is inserted into the through bore 3 of the valve holding body 1. A central blind bore 13 is also made in the valve holding body 1, originating at the lower end face 7 of the preferably cylindrical valve holding body 1; this blind bore has an enlarged diameter and thus forms a spring chamber 15 for receiving a valve spring, not shown here, in the valve holding body 1. This spring chamber 15 can be connected to an external leakage line via a connecting conduit 17, which is formed by an axial longitudinal bore 19 and a transverse bore 21 intersecting the longitudinal bore.

Alternatively, the connecting conduit 17 can also be inclined or can discharge at the upper end face 5.

In the course of its axial length, the valve holding body 1 has an offset bend 23, by means of which the upper partial region of the valve holding body 1, having the larger-diameter portion 9 of the through bore 3, is axially offset from the remaining, lower partial region. To that end, a center axis 24 of the component 1 has a partial region at the level of the offset bend 23, in which region the center axis 24 extends obliquely to the axis of the bore 3 and by which the center axis 24 is displaced partly out of an imaginary total center axis 26 of the valve holding body 1.

The size of the offset bend 23 on the valve holding body 1 depends on the center offset of the through bore 3 and on the position of an adjoining thread 25 on the upper end of the valve holding body 1. In order to attain the largest possible size of axial offset of the through bore 3 from the imaginary center axis 26 of the valve holding body 1 while at the same time having a simultaneous disposition of the through bore 3 in the upper end face 5, a further half-side offset bend 27 is provided on the upper end of the valve holding body 1, thus forming an eccentric disposition of the adjoining thread 25 on the valve holding body 1.

The second exemplary embodiment, shown in FIG. 2, of an offset-bent valve holding body differs from the first exemplary embodiment shown in FIG. 1 only in the embodiment of the upper region of the valve holding body. The second offset bend 27 in the upper region of the valve holding body 1 is omitted here, so that the adjoining thread 25 is now centrally disposed to this upper region of the valve holding body 1.

The component according to the invention having a bore is described here in terms of a valve holding body for fuel injection valves of internal combustion engines, but it may also be provided on any other machine components in which a central bore entrance and an eccentric bore exit, for instance, from a component body is necessary.

The foregoing relates to a preferred exemplary embodiments of the invention, it being understood that other variants and embodiments thereof are possible within the spirit and scope of the invention, the latter being defined by the appended claims.

What is claimed is:

1. A fuel injector comprising:

a body having an upper region, an off-set bend region and a lower region;

the body having a first axis along a longitudinal centerline of the upper region;

the body having a second axis along a longitudinal centerline of the lower region, the second axis being parallel to the first axis;

the upper region and the lower region separated by the off-set bend region, the off-set bend region having a third axis along a longitudinal centerline of the off-set bend, the third axis having an angle of inclination relative to the first axis and the second axis;

the body having a through bore along the first axis, the through bore entering centrally to a first end face of the upper region, the through bore exiting eccentrically to a second end face of the lower region, the first end face being opposite the second end face;

the lower region having a central blind bore along the second axis, the central blind bore entering centrally to second end face of the lower region.

2. The fuel injector according to claim 1, in which an axial length of the body (1) is a multiple of its cross-sectional area.

3. The fuel injector according to claim 1, in which the through bore (3) is embodied as a stepped bore, having at least two different bore diameters (9, 11).

4. The fuel injector according to claim 1, in which the through bore has a bore segment (9) of greater diameter formed in the upper region of the body (1) that enters centrally at the first end face (5).

5. The fuel injector according to claim 3, in which the through bore has a bore segment (9) of greater diameter formed in the upper region of the body (1) that enters centrally at the first end face (5).

6. The fuel injector according to claim 1, in which the through bore has a bore segment (11) of lesser diameter formed in the lower region of the body (1) that enters eccentrically at the second end face (7).

7. The fuel injector according to claim 3, in which the through bore has a bore segment (11) of lesser diameter formed in the lower region of the body (1) that enters eccentrically at the second end face (7).

8. The fuel injector according to claim 1, in which a connecting conduit (17) leads away from the central blind bore (13) and discharges at a radial circumferential face of the body (1).

9. The fuel injector according to claim 1, in which the by (1) is embodied as a valve holding body.

10. The fuel injector according to claim 1, in which the through bore (3) forms a high-pressure fuel conduit, and the central blind bore (13) forms a chamber (15) for receiving an object.

11. The fuel injector according to claim 1, in which the through bore (3) forms a high-pressure fuel conduit, and the central blind bore (13) forms a chamber (15) for receiving an object.

* * * * *